United States Patent [19]

Iwai et al.

[11] 4,218,132

[45] Aug. 19, 1980

[54] DRUM CLEANING APPARATUS FOR ELECTROPHOTOGRAPHIC COPYING MACHINE

[75] Inventors: Fumio Iwai; Masakazu Kokiso; Junichi Koiso; Tamio Ogino, all of Hachioji, Japan

[73] Assignee: Konishiroku Photo Industry Co., Ltd., Tokyo, Japan

[21] Appl. No.: 965,024

[22] Filed: Nov. 30, 1978

[30] Foreign Application Priority Data

Dec. 20, 1977 [JP] Japan ..... 52-152448

[51] Int. Cl.[2] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 3,740,789 | 6/1973 | Ticknor | 355/15 X |
| 3,926,517 | 12/1975 | Nagahara | 355/15 X |
| 3,977,898 | 8/1976 | Hwa | 355/15 X |
| 4,140,388 | 2/1979 | Ikesue | 355/15 |

*Primary Examiner*—Fred L. Braun

*Attorney, Agent, or Firm*—Bierman & Bierman

[57] ABSTRACT

A drum cleaning apparatus for an electrophotographic copying machine includes a toner image forming drum rotatable about a horizontal axis, a blade for scraping off toner particles deposited on the cylindrical outer surface of the drum, an inclined toner particle guide plate having an upper edge bearing on the outer surface of the drum upstream of the scraping blade as viewed in the rotating direction of the drum and a lower edge positioned at an opening of a toner collecting container, a holding structure for supporting the toner guide plate and mounted swingably on a shaft with play, the shaft extending in parallel with the axis of said drum. Feeble and periodical shocks are applied to the toner guide plate by way of the supporting shaft thereby to promote the sliding down of the toner particles on and along the guide plate into the collecting container to prevent accumulation of the particles on the plate.

3 Claims, 2 Drawing Figures

DRUM CLEANING APPARATUS FOR ELECTROPHOTOGRAPHIC COPYING MACHINE

BACKGROUND OF THE INVENTION

1. Field of the Invention

The present invention relates to an apparatus for cleaning a rotating drum of an electrophotographic copying machine. In general, a transfer type electrophotographic copying machine or apparatus includes a rotatable drum having an outer cylindrical surface provided with a photo-conductive layer in which an electrostatic latent image of an original to be copied is produced during the rotation of the drum and subsequently developed by a toner, the developed toner image being then transferred to a transfer sheet such as plain paper. In such copying machine, it is required to remove the toner particles possibly remaining as deposited on the outer surface of the drum even after the image transfer has been finished. The invention is directed to an apparatus for cleaning the drum in this sense.

2. Description of the Prior Art

In a hitherto known drum cleaning apparatus of the type described above which includes a rotatable drum 1 rotated about a horizontal axis in the direction indicated by an arrow in FIG. 1 of the accompanying drawings, a cleaning blade 2 which is referred to as the doctor blade is so disposed relative to the drum 1 that the lower edge is brought into contact with the outer cylindrical surface of the drum at a portion moving upwardly as shown in FIG. 1.

Through the sliding movement of the blade 2 on and along the outer cylindrical surface of the drum 1, the toner particles deposited on the drum surface are scraped off as the drum is rotated.

The toner particles T thus scraped off from the outer cylindrical surface of the drum will fall along an arcuate path corresponding to a segment of the outer cylindrical surface of the drum 1 delimited by the cleaning blade 2 and then fall freely downwardly. Accordingly, it is certainly possible to collect the toner particles by a container disposed in the free falling path of the toner particles.

However, this arrangement requires disadvantageously a relatively large occupation space around the cylindrical surface of the drum 1. With a view to avoiding such difficulty, it has been already known that the toner collecting container 3 is disposed at a relatively great distance from the drum 1, wherein the toner particles falling along the outer cylindrical surface of the drum are deflected toward the collecting container 3 by way of an inclined guide plate 4 having an upper edge bearing on the outer cylindrical surface of the drum 1 at the upstream side of the scraper blade 2 as viewed in the rotating direction of the drum 1, and lower edge positioned at the inlet opening of the container 3 thereby to introduce the toner particles therein from the outer surface of the drum.

With the toner collecting arrangement just described above, it is necessary that the upper edge of the guide plate 4 is in contact with the outer cylindrical surface of the drum under a constant and small pressing force uniformly over the whole width of the upper edge thereby to prevent accumulation of the toner particles on the guide plate 4.

In practice, however, the loose fluidity or mobility of the toner particles is often degraded in dependence on the environmental conditions prevailing in the copying machine (e.g. humidity is the most influential factor).

In such case, the toner particles scraped off from the drum surface will not be smoothly introduced into the collecting container 3 but deposited and progressively accumulated on the surface of the guide plate 4, as a result of which the toner particles T will overflow from the gude plate 4 on the way to the collecting container 3 and will cause undesirable contamination of the drum as well as of the interior of the copying machine.

Besides, there may occur such situation that the angle as well as pressing force at which the guide plate 4 bears on the outer surface of the drum 1 will undergo variation, whereby the toner particles T are scraped off from the drum by the guide plate 4 and hence the photo-sensitive layer may be eventually injured.

As an attempt to deal with the problem described above, it is conceivable that vibration or intermittent shocks are applied to the guide plate 4 thereby to promote a more smooth movement of the toner particles on the guide plate 4. However, application of such vibrations or intermittent shocks in an uncontrolled manner will exert adverse influence to the adjusted contact between the upper edge of the guide plate 4 and the outer surface of the drum 1, involving the separation of the former from the latter.

In other words, it is necessary that the shocks or vibration has to be so controlled that substantially no displacement of the guide plate 4 relative to the drum surface will occur, while the sliding down of the toner particles is promoted.

SUMMARY OF THE INVENTION

Accordingly, an object of the present invention is to provide a drum cleaning apparatus for an electrophotographic copying machine which is capable of collecting the toner particles in a toner collecting container without giving rise to any displacement of the toner guiding plate relative to the drum surface.

In view of the above and other objects of the invention which will become more apparent as the description proceeds, there is proposed according to a general aspect of the invention an apparatus for cleaning a rotating drum surface for producing a toner image of an original to be copied in an electrophotographic copying machine, comprising a toner scraping blade positioned to bear on the outer cylindrical surface of the drum; supporting shaft means extending in parallel with the axis of the cylindrical drum; a toner guide chute plate having upper edge caused to bear on the cylindrical outer surface of the drum below and upstream of the scraping blade as viewed in the rotating direction of the drum; and a lower edge positioned at an opening of a collecting container means for holding said toner guide chute plate, the holding means being supported swingably on the supporting shaft means with a play; and means for applying shocks on the toner guide chute plate through the supporting shaft means.

The above and other objects, novel features and advantages of the invention will become more apparent from the description of preferred embodiments thereof taken in conjunction with the accompanying drawings.

DETAILED DESCRIPTION OF THE PREFERRED EMBODIMENTS

Figure 1:
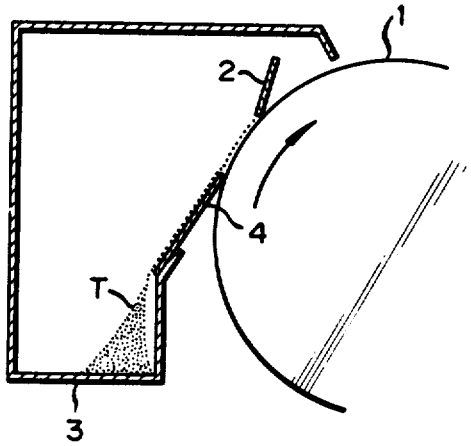
FIG. 1 PRIOR ART
FIG. 1 is a schematic sectional view of a hitherto known electrophotographic copying machine to illustrate a conventional drum cleaning apparatus.

Now, an exemplary embodiment of the invention will be described by referring to FIG. 2, in which same reference numerals are employed to denote the same parts as shown in FIG. 1. A toner collecting container 3 of a box-like configuration disposed at a side of the cylindrical drum 1 is constituted by side wall plates 3A in which a front and a rear side wall as viewed in the drawing carry an inwardly extending supporting shaft 5 in parallel with the horizontal axis of the drum 1.

A guide plate holding member 6 which is composed of a pair of arm plates 6A disposed in opposition to each other with a distance therebetween corresponding to the width of the cylindrical drum 1 and connected together by a bridge portion or plate 6B at the ends of the plates 6A is secured to the toner guide plate 4 at the lower side thereof by means of the bridge plate 6B.

Each of the arm plates 6A is formed with a through-hole 7 at a substantially central location which has a much larger diameter than that of the supporting shaft 5, whereby the respective arm plates 6A are supported by shaft 5 with a large play.

A counter weight 8 which is adjustable in position is provided at the other end of the arm plate 6A. There is further provided a driving shaft 9 in the toner collecting container 3 extending in parallel with the axis of the drum 1 and adapted to be driven by a drive motor (not shown) in the same direction as the drum 1. The drive shaft 9 is provided with a vane 10 for scraping off the toner, which vane is of a length selected so as to pass by the lower end of the toner guide plate or chute 4. Besides, a hammer member 11 is connected to the driving shaft 9 through a compression or coil spring 12 between the rear side wall 3A of the container 3 and the arm plate 6A and extends radially outwardly slightly beyond the distance between the supporting shaft 5 and the driving shaft 9.

The toner guide chute or plate 4 is preferably formed of a film or sheet material having a flexibility of some degree which is insusceptible to adhesion of the toner particles and unlikely to injure the photo-conductive layer of the drum 1. For example, a film of polyestel, a sheet of chloroprene or polyurethane or the like may be used for the toner chute plate 4.

With the structure of the drum cleaning apparatus according to the invention described above, the guide plate holding member 6 is supported on the shaft 5 swingably around the contacting point between the shaft 5 and the circular periphery of the through-hole 7 serving as the fulcrum and can be set in a balanced state independently from the drum 1 by selecting the weight and the position of the counter-weight 8.

Such balanced state can be attained easily even in any given inclined state of the toner guide plate 4 by virtue of the fact that the supporting shaft 5 is inserted through the opening 7 with a large play.

In other words, the toner guide chute 4 can be held in such manner that the upper edge thereof is brought in stable contact with the drum surface under an extremely small pressure on the order of 0.1 to 0.3 gr./cm by correspondingly adjusting the weight and/or the position of the counter-weight 8 in a desired inclined position of the toner guide chute plate 4. When the driving shaft 9 is rotated in the direction shown by an arrow, the hammer member 11 will strike at the supporting shaft 5, whereby the shock as produced is transmitted to the guide plate holding member 6 and hence to the toner guide plate 4.

In this connection, it is to be noted that the guide plate holding member 6 is held loosely in linear contact with the supporting shaft 5 which is coupled substantially stationarily to the main body of the copying machine.

Accordingly, only feeble vibration is transmitted to the toner guide chute 4 without giving rise to any displacement thereof. Thus, it is possible to prevent deposition and stagnation of the toner particles T on the guide plate 4, thereby to promote the sliding down and introduction of the toner particles into the toner collecting container 3. It will be seen that the hammer member 11 can strike at and pass by the supporting shaft 5 by virtue of the resilient deformation of the coil spring 12. Further, because the hammer member 11 is positioned between the rear side wall of the container 3 and the adjacent arm plate 6A, there is no fear that the hammer member 11 might directly strike at the guide chute plate 4.

Figure 2:
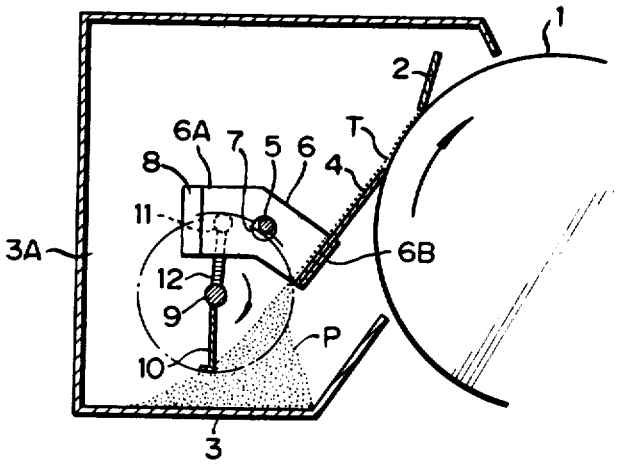
FIG. 2 is a schematic sectional view of a drum cleaning apparatus according to an embodiment of the invention.

On the other hand, the scraping vane 10 rotated by the driving shaft 9 serves to shovel the toner particle stack P to move to the left as viewed in FIG. 2.

As the result, the toner stack P is prevented from being increased in height up to or beyond the lower edge of the toner guide plate or chute 4. By selecting the length of the supporting shaft 5 so as not to protrude into the rotating space of the vane 10, impingement of the vane to the shaft 5 can be evaded.

In an example of the invention, a copying operation test was carried out in an electrophotographic copying machine provided with a toner guide chute plate made of a polyester sheet of 100 microns thick together with the drum cleaning apparatus according to the invention. When the driving shaft 9 was rotated continuously at revolution speed of 15 rpm., no deposition and accumulation or stagnation of the toner particles on the toner guide plate 4 was found even after more than 3000 times of copying operations.

Some effect can be accomplished when the driving shaft 9 was rotated once after every copying operation, whereby the toner particles scraped off by the blade 2 could be collected in the container 3 in a satisfactory manner.

On the other hand, in the case where the driving shaft 9 was held in the stationary state, a remarkable accumulation of the toner particles was resulted on the toner guide plate 4 when the number of copying cycles attained 2000 times, with a considerable quantity of the toner particles being sprinkled around.

In the foregoing description, it has been assumed that the shock application mechanism is operated by the same driving shaft for the scraping and feeding vane.

However, it is equally possible to drive the shock application mechanism independently from the scraping and feeding blade 10 by resorting to the use of another driving structure.

As will be appreciated from the foregoing description, the drum cleaning apparatus for an electrophotographic copying machine according to the invention can be implemented in a much simplified construction and is very effective for maintaining the toner particle guide plate in a desired clean state by preventing deposition and accumulation of the toner particles on the guide plate through application of feeble vibration or periodical shocks, thereby to assure the collection of the toner particles in the toner collection container to eventually enhance the performances of the electrophotographic copying machine.

While the invention has been described in conjunction with the exemplary embodiment illustrated in the drawings, it will be understood that the invention is never restricted thereto but many modifications and variations will easily occur to those skilled in the art without departing from the scope and spirit of the invention.

We claim:

1. An apparatus for cleaning a rotating drum surface for producing a toner image of an original to be copied in an electrophotographic copying machine, comprising a toner scraping blade positioned to bear on the outer cylindrical surface of the drum;

a supporting shaft means extending in parallel with the axis of the cylindrical drum;

a toner guide chute plate having an upper edge caused to bear on the cylindrical outer surface of the drum below and upstream of the scraping blade as viewed in the rotating direction of the drum and a lower edge positioned at an opening of a collecting container;

means for holding said toner guide chute plate on said supporting shaft means with play; and means for applying shocks on the toner guide chute plate through the supporting shaft means.

2. An apparatus as set forth in claim 1 wherein the shock applying means includes a driving shaft extending in parallel with the supporting shaft means and adapted to be rotated, and a hammer means connected to the driving shaft through a resiliently deformable member so that the hammer means strikes the supporting shaft means when rotated by the driving shaft.

3. An apparatus as set forth in claim 2 further including a vane mounted on the driving shaft and adapted to move toner particles falling in said container to prevent formation of a stack of toner particles below said lower edge of said guide chute plate.

* * * * *